US012318060B2

(12) United States Patent
Cho et al.

(10) Patent No.: US 12,318,060 B2
(45) Date of Patent: Jun. 3, 2025

(54) CLEANER

(71) Applicant: SAMSUNG ELECTRONICS CO., LTD., Suwon-si (KR)

(72) Inventors: Dongjin Cho, Suwon-si (KR); Ohkyu Kwon, Suwon-si (KR); Youngjun Cho, Suwon-si (KR); Seongtae Chu, Suwon-si (KR); Hyeonwoo Tak, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 256 days.

(21) Appl. No.: 17/591,862

(22) Filed: Feb. 3, 2022

(65) Prior Publication Data

US 2022/0322900 A1 Oct. 13, 2022

Related U.S. Application Data

(63) Continuation of application No. PCT/KR2022/000220, filed on Jan. 6, 2022.

(30) Foreign Application Priority Data

Apr. 9, 2021 (KR) ..... 10-2021-0046669

(51) Int. Cl.

| | |
|---|---|
| ***A47L 9/14*** | (2006.01) |
| ***A47L 5/28*** | (2006.01) |
| ***A47L 9/12*** | (2006.01) |

(52) U.S. Cl.

CPC ..... *A47L 9/149* (2013.01); *A47L 5/28* (2013.01); *A47L 9/127* (2013.01); *A47L 9/1409* (2013.01); *A47L 9/1463* (2013.01)

(58) Field of Classification Search

CPC ..... A47L 9/127; A47L 9/1409; A47L 9/1463; A47L 9/149; A47L 5/28

See application file for complete search history.

(56) References Cited

U.S. PATENT DOCUMENTS

| | | | | |
|---|---|---|---|---|
| 7,836,546 | B2 | 11/2010 | Yoo et al. | |
| 2001/0025395 | A1 | 10/2001 | Matsumoto et al. | |
| 2019/0167058 | A1* | 6/2019 | Cho | A47L 9/104 |
| 2020/0281429 | A1 | 9/2020 | Cho et al. | |
| 2022/0346609 | A1 | 11/2022 | Kwak et al. | |

FOREIGN PATENT DOCUMENTS

| | | | |
|---|---|---|---|
| CN | 212816082 | U | 3/2021 |
| JP | 2009-268564 | A | 11/2009 |
| JP | 2013-135997 | | 7/2013 |
| KR | 10-2006-0037983 | | 5/2006 |

(Continued)

OTHER PUBLICATIONS

International Search Report dated May 3, 2022, in International Application No. PCT/KR2022/000220.

(Continued)

*Primary Examiner* — Andrew A Horton

(74) *Attorney, Agent, or Firm* — STAAS & HALSEY LLP

(57) ABSTRACT

A cleaner includes a housing, a body slidably coupled to the housing, a dust container mountable to the housing and detachable from the housing, and a pushing device slidably coupled to the dust container and mountable to the body and detachable from the body.

13 Claims, 20 Drawing Sheets

(56) References Cited

FOREIGN PATENT DOCUMENTS

| | | | |
|---|---|---|---|
| KR | 10-2009-0041299 | | 4/2009 |
| KR | 10-2010-0104792 | | 9/2010 |
| KR | 10-2018-0076257 | A | 7/2018 |
| KR | 10-2019-0066239 | A | 6/2019 |
| KR | 10-2020-0107756 | A | 9/2020 |
| KR | 10-2020-0145065 | | 12/2020 |
| KR | 10-2021-0039175 | | 4/2021 |

OTHER PUBLICATIONS

Extended European Search Report dated May 2, 2024 for European Application No. 22784746.4.

* cited by examiner

CLEANER

CROSS REFERENCE TO RELATED APPLICATIONS

This application is a continuation application under 35 U.S.C. § 111(a) of International Application No. PCT/KR2022/000220, filed on Jan. 6, 2022, which claims priority to Korean Patent Application No. 10-2021-0046669 filed on Apr. 9, 2021. The disclosures of International Application No. PCT/KR2022/000220 and Korean Patent Application No. 10-2021-0046669 are incorporated by reference herein in their entireties.

BACKGROUND

1. Field

The disclosure relates to a cleaner, and for example, to a cleaner including an improved dust discharge structure.

2. Description of Related Art

A cleaner is a device configured to clean a room by removing rubbish, and a vacuum cleaner is generally used at the home. The vacuum cleaner uses suction power of a fan motor unit to suction air, and then sorts rubbish in the sucked air with a device such as a filter, thereby keeping the room clean. The vacuum cleaner may be classified into a canister type and an upright type. Recently, a robot vacuum cleaner has been popular and the robot vacuum cleaner is configured to travel in a cleaning area by itself without user intervention and perform cleaning by sucking rubbish, such as dust, from a surface to be cleaned.

The vacuum cleaner includes a dust collector therein so that the rubbish contained in the sucked air is filtered out by a predetermined filtering device. The filtering device installed in the dust collector and provided to filter out rubbish is classified into a porous filter device provided to forcibly filter out rubbish while air passes therethrough, and a cyclone-type dust collector provided to filter out rubbish in cyclone air flow.

In the vacuum cleaner, rubbish, such as hair or animal hair, gets tangled in the dust collector in the process of filtering out the rubbish and the user has to separate the rubbish from the dust collector. Therefore, the vacuum cleaner is unsanitary and inconvenient to use.

SUMMARY

Therefore, one or more aspects of the disclosure relate to providing a cleaner capable of easily discharging rubbish collected in a dust container.

One or more aspects of the disclosure relate to providing a cleaner capable of easily managing a dust container.

Additional aspects of the disclosure will be set forth in part in the description which follows and, in part, will be apparent from the description, or may be learned by practice of the disclosure.

In accordance with an aspect of the disclosure, a cleaner includes a housing, a body slidably coupled to the housing, a dust container mountable to the housing and detachable from the housing, and a pushing device slidably coupled to the dust container and mountable to the body and detachable from the body.

The housing may include a housing coupling portion, and the dust container may include a dust container coupling portion which is coupled to the housing coupling portion when the dust container is rotated about the housing in a first direction.

The body may include a body coupling portion, and the pushing device may include a pushing device coupling portion which is coupled to the body coupling portion when the pushing device is rotated about the body in the first direction.

In response to the dust container coupling portion being separated from the housing coupling portion when the dust container is rotated about the housing in a second direction, the pushing device coupling portion may be separated from the body coupling portion.

The housing coupling portion may be disposed on a same line as the body coupling portion along a direction in which the housing extends.

The pushing device coupling portion may include a material having elasticity, and the body coupling portion may include a guide inclined portion to guide the pushing coupling portion to a position of being mounted to the body coupling portion when the pushing device is moved linearly and then mounted to the body.

The dust container may include a guide portion to guide a sliding movement of the pushing device, and the pushing device may include a guide rail guided by the guide portion.

The body may include a body rail connected to the guide rail and guided by the guide portion when the pushing device is mounted to the body.

The guide portion may include a plurality of guide portions including a first guide portion and a second guide portion. The second guide portion may be disposed to form an angle with the first guide portion which is less than 180 degrees, with respect to a central axis along a direction in which the dust container extends.

The guide portion may be provided to limit rotation of the pushing device with respect to the dust container.

The dust container may include a filtering device, and the pushing device may include a rubbish separation device to filter air passing through the filtering device.

The pushing device may include a first rubbish removing member to discharge rubbish filtered out in the filtering device when the pushing device slides inside the dust container, and a second rubbish removing member to discharge rubbish filtered out in the rubbish separation device when the pushing device slides inside the dust container.

The pushing device may include an opening and closing device configured to open and close an open end of the dust container.

The body may include a fan motor unit disposed on a first side of the body which is coupled to the pushing device, a handle disposed on a second side of the body which is opposite to the first side of the body, and a battery mounting portion disposed between the fan motor unit and the handle.

The pushing device may include a motor filter disposed on a side of the pushing device which is coupled to the body.

In accordance with an aspect of the disclosure, a cleaner includes a housing, a body slidably coupled to the housing and including a body coupling portion, a dust container mountable to the housing and detachable from the housing, and a pushing device slidably coupled to the dust container and including a pushing device coupling portion mountable to the body coupling portion of the body and detachable from the body coupling portion of the body, based on a rotation of the pushing device about the body.

The housing may include a housing coupling portion, and the dust container may include a dust container coupling portion which is coupled to the housing coupling portion when the dust container is rotated about the housing in a first direction. In response to the dust container coupling portion being separated from the housing coupling portion when the dust container is rotated about the housing in a second direction, the pushing device coupling portion may be separated from the body coupling portion.

The dust container may include a guide portion to guide a sliding movement of the pushing device, and the pushing device may include a guide rail guided by the guide portion.

The guide portion may be provided to limit rotation of the pushing device with respect to the dust container.

In accordance with an aspect of the disclosure, a cleaner includes a housing including a housing coupling portion, a body slidably coupled to the housing and including a body coupling portion, a dust container mountable to the housing and detachable from the housing. The dust container may include a dust container coupling portion which is coupled to the housing coupling portion when the dust container is rotated about the housing in a first direction. The cleaner may further include a pushing device slidably coupled to the dust container and including a pushing device coupling portion which is mountable to the body coupling portion of the body and detachable from the body coupling portion of the body, based on a rotation of the pushing device about the body. The dust container may include a guide portion to guide a sliding movement of the pushing device and to limit rotation of the pushing device with respect to the dust container, and the pushing device may include a guide rail guided by the guide portion.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
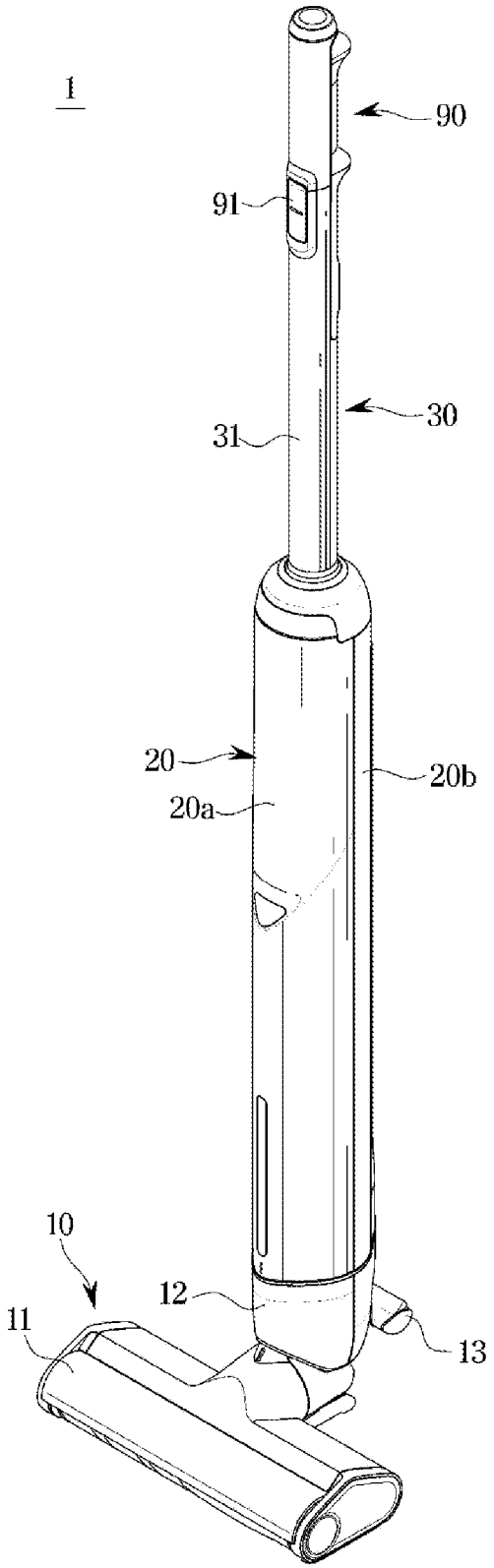
FIG. 1 is a view illustrating a cleaner according to an embodiment of the disclosure.

Embodiments described in the disclosure and configurations illustrated in the drawings are merely examples of the embodiments of the disclosure, and may be modified in various different ways to replace the embodiments and drawings of the disclosure.

In addition, the same reference numerals or signs illustrated in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, terms such as "including", "having", "comprising", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but the elements are not limited by these terms. These terms are only used to distinguish one element from another element. For example, without departing from the scope of the disclosure, a first element may be termed as a second element, and a second element may be termed as a first element.

The term of "and/or" includes a combination of a plurality of related listed items or any item of the plurality of related listed items. For example, the scope of the expression or phrase "A and/or B" includes the item "A", the item "B", and the combination of items "A and B".

In addition, the scope of the expression or phrase "at least one of A and B" is intended to include all of the following: (1) at least one of A, (2) at least one of B, and (3) at least one of A and at least one of B. Likewise, the scope of the expression or phrase "at least one of A, B, and C" is intended to include all of the following: (1) at least one of A, (2) at least one of B, (3) at least one of C, (4) at least one of A and at least one of B, (5) at least one of A and at least one of C, (6) at least one of B and at least one of C, and (7) at least one of A, at least one of B, and at least one of C.

It will be understood that when an element is referred to as being "connected" to another element, the expression encompasses an example of a direct connection or direct coupling, as well as a connection or coupling with another element interposed therebetween.

Hereinafter example embodiments according to the disclosure will be described in detail with reference to the accompanying drawings, wherein like reference numerals refer to like elements throughout. In FIG. 1, a portion in which a suction head 10 is arranged may be defined as a front side, and a portion in which a handle 90 is arranged may be defined as a rear side. That is, it may be defined that air is introduced from the front side of a cleaner 1 and discharged to the rear side. However, the shape and position of each component is not limited by the terms defined in this way.

Figure 2:
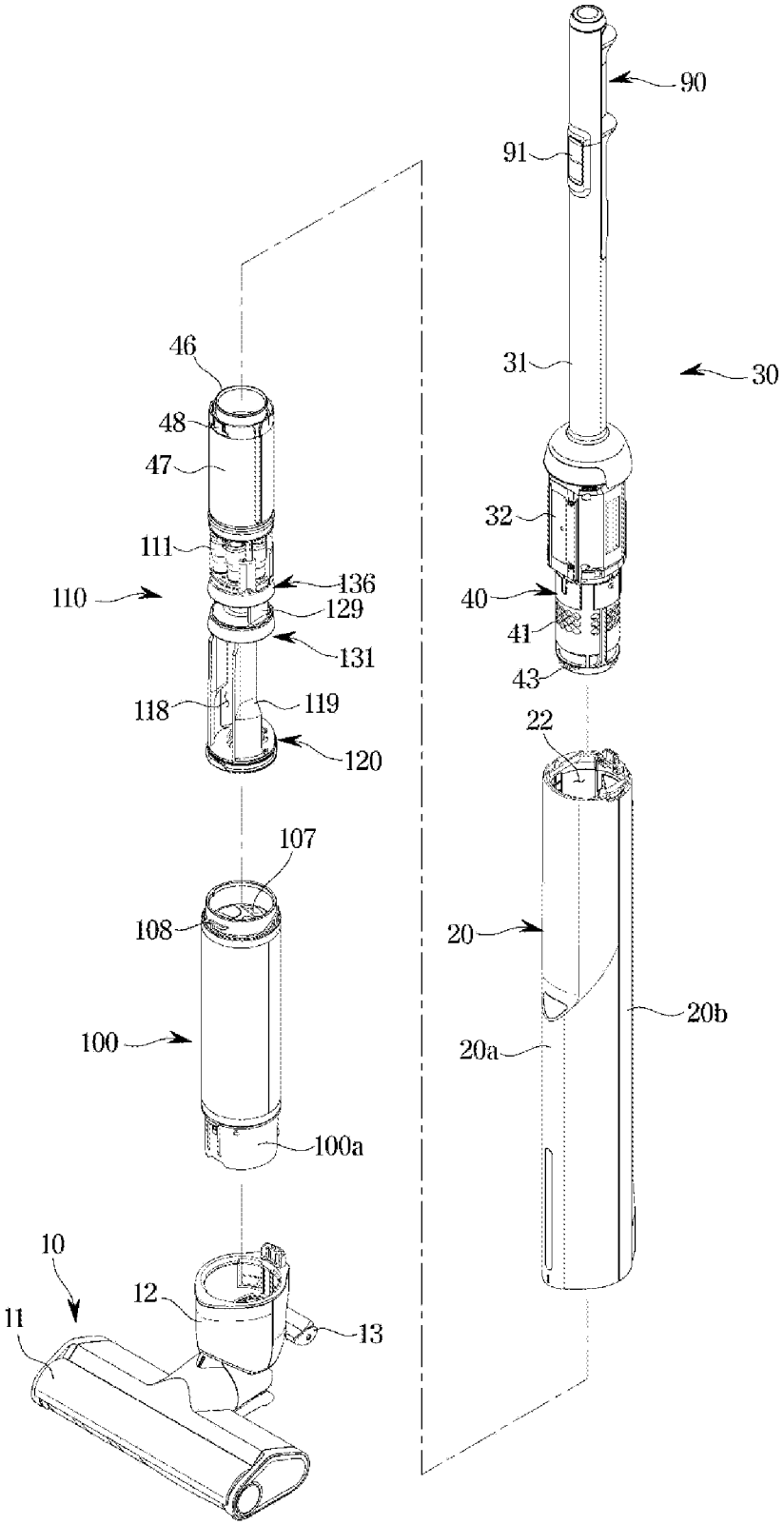
FIG. 2 is an exploded view illustrating the cleaner illustrated in FIG. 1.
Figure 3:
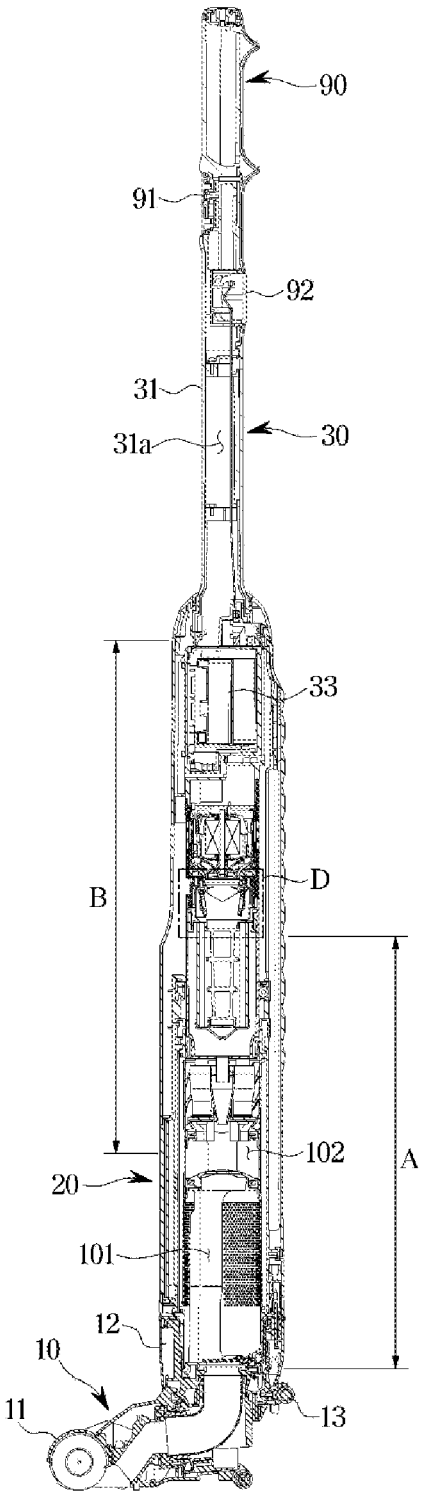
FIG. 3 is a cross-sectional view illustrating the cleaner illustrated in FIG. 1.
Figure 4:
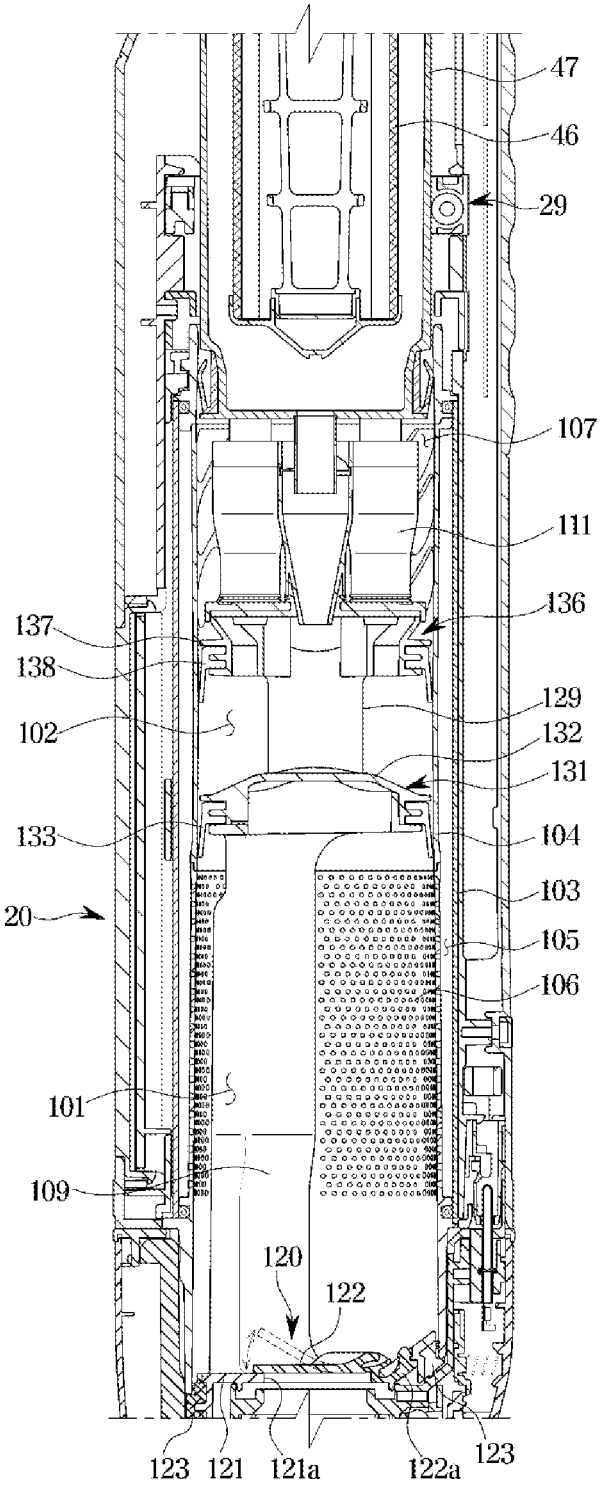
FIG. 4 is an enlarged view illustrating a part A illustrated in FIG. 3.
Figure 5:
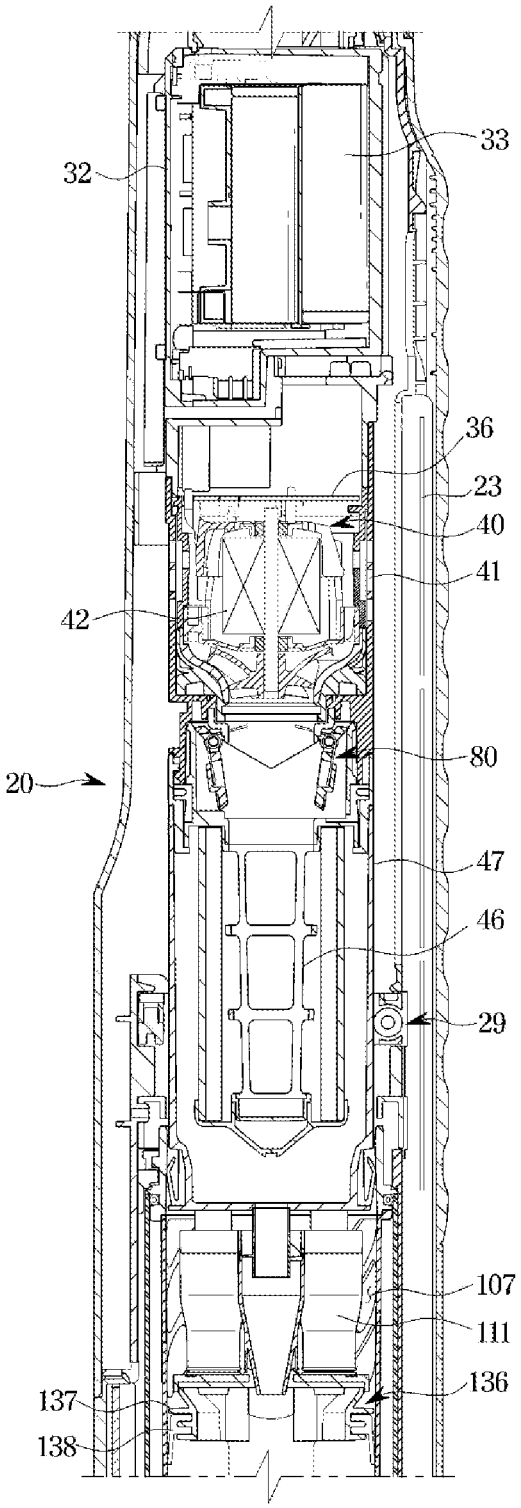
FIG. 5 is an enlarged view illustrating a part B illustrated in FIG. 3.
Figure 6:
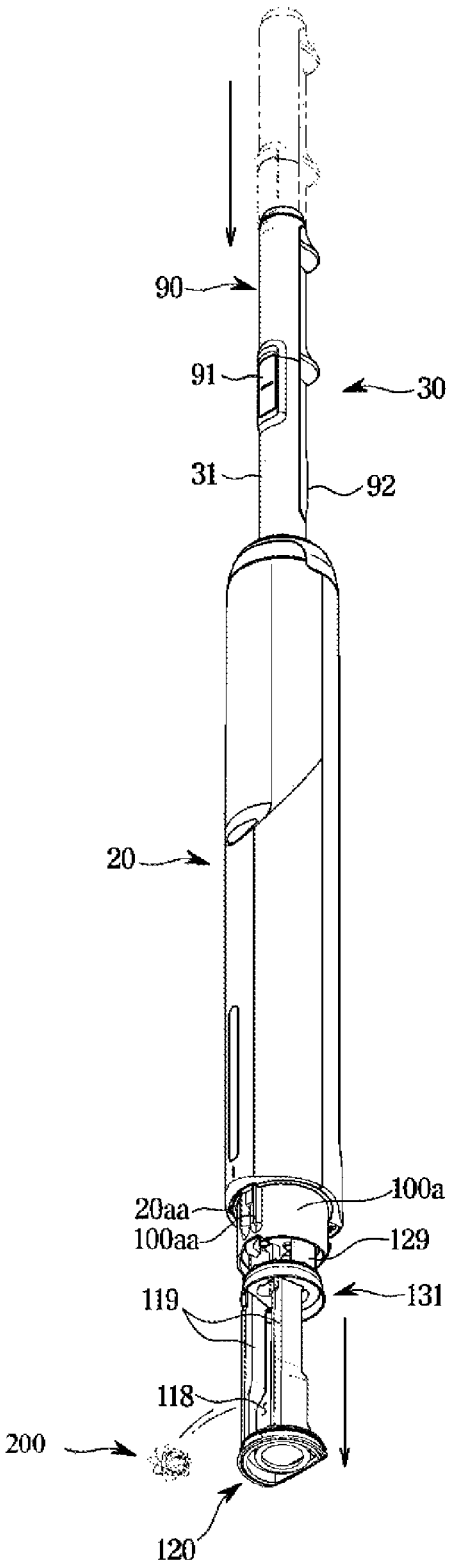
FIG. 6 is a view illustrating a state in which dust is discharged from the cleaner illustrated in FIG. 1.

FIG. 1 is a view illustrating a cleaner according to an embodiment of the disclosure. FIG. 2 is an exploded view illustrating the cleaner illustrated in FIG. 1. FIG. 3 is a cross-sectional view illustrating the cleaner illustrated in FIG. 1. FIG. 4 is an enlarged view illustrating a part A illustrated in FIG. 3. FIG. 5 is an enlarged view illustrating a part B illustrated in FIG. 3. FIG. 6 is a view illustrating a state in which dust is discharged from the cleaner illustrated in FIG. 1.

Referring to FIGS. 1 and 2, the cleaner 1 may include a suction head 10 provided to suck rubbish, such as hair on a surface to be cleaned, by a suction force of air, a housing 20 connected to the suction head 10, a body 30 movably provided inside the housing 20, a dust container 100 detachably mounted on the housing 20, and a pushing device 110 slidably mounted on the dust container 100.

The suction head 10 is provided to suck rubbish such as dust placed on a surface to be cleaned while moving on the surface to be cleaned. The suction head 10 may include a head assembly 11, a neck portion 12, and a head switch 13.

An air flow path may be formed inside the head assembly 11. The air flow path formed inside the head assembly 11 may communicate with the housing 20 through the neck portion 12. Outside air and rubbish introduced through the head assembly 11 may be moved into the housing 20 through the neck portion 12.

The neck portion 12 may be connected to a lower end of the housing 20. The neck portion 12 may be rotatably coupled to the head assembly 11. As the neck portion 12 is rotated about the head assembly 11, the head assembly 11 may be rotated about the housing 20 connected to the neck portion 12. Accordingly, a degree of freedom of the driving the cleaner 1 may be improved.

The head switch 13 is configured to fix or release a coupling state between the suction head 10 and the housing 20. A user may operate the head switch 13 to separate the housing 20 from the suction head 10. Because the head switch 13 is arranged on the suction head 10, the user can separate the housing 20 from the suction head 10 by operating the head switch 13 using the foot without bending at the waist.

The housing 20 may form a portion of an exterior of the cleaner 1. One end of the housing 20 may be mounted to the suction head 10. For example, the housing 20 may be coupled to the suction head 10 in a state in which one end 100*a* of the dust container 100 is inserted into the neck portion 12 of the suction head 10. The housing 20 may include a hollow 22 formed to allow the body 30 to be movably inserted therein. The housing 20 may include a front housing 20*a* and a rear housing 20*b*.

Referring to FIG. 3, the body 30 may be slidably coupled to the housing 20. The body 30 may be provided to be movable between a first position for closing dust collecting chambers 101 and 102 formed inside the dust container 100 and a second position for opening the dust collecting chambers 101 and 102.

Referring to FIG. 5, a guide device 29 may be provided between the housing 20 and the body 30. The guide device 29 may guide and support a movement of the body 30 with respect to the housing 20.

The body 30 may include an extended portion 31 forming a part of an exterior of the cleaner 1. A space 31*a* provided to accommodate an electric wire extending toward an operation switch 91 may be formed inside the extended portion 31.

The handle 90 may be arranged at the rear end of the extended portion 31. The handle 90 may be arranged at the other end opposite to one end at which a fan motor unit 40 of the body 30 is arranged. When a user uses the cleaner 1, the user may push or pull the suction head 10 by gripping the handle 90.

The handle 90 may be provided with the operation switch 91 for controlling an operation of the cleaner 1. The operation switch 91 is provided to receive a command for operating the cleaner 1 from the user. The operation switch 91 may be arranged adjacent to the handle 90 to allow a user to operate the cleaner 1 while the user moves the cleaner 1.

The body 30 may include a battery mounting portion 32. A battery 33 may be mounted in the battery mounting portion 32. One or two or more batteries 33 may be provided. The battery mounting portion 32 may be located inside the housing 20.

The body 30 may be provided with the fan motor unit 40 configured to generate a suction force necessary to suck rubbish on a surface to be cleaned. The fan motor unit 40 may be configured to introduce outside air through the suction head 10 and discharge the suctioned air through a discharge port 23 of the housing 20. The fan motor unit 40 in a state of being mounted on the body 30 may be arranged inside the housing 20. The fan motor unit 40 may include a fan motor 42.

The cleaner 1 according to an embodiment of the disclosure may be provided such that a portion of the body 30, in which the fan motor unit 40 is arranged, is partitioned from the battery mounting portion 32. That is, air flowing by the fan motor unit 40 does not move to the battery mounting portion 32 and the handle 90, but is directly discharged through a motor discharge port 41 and the discharge port 23 of the housing 20. Accordingly, the cleaner 1 according to an embodiment of the disclosure may minimize the discharge of the air toward the user.

In addition, in the cleaner 1 according to an embodiment of the disclosure, because the fan motor unit 40, which is relatively heavier than the battery 33, is arranged below the battery 33, the center of gravity may be relatively lowered. Accordingly, the cleaner 1 according to the embodiment of the disclosure may lower the center of gravity relatively, and thus it is possible to increase the convenience of use.

A controller 36 may be arranged between the fan motor unit 40 and the battery mounting portion 32. The controller 36 may be provided as a printed board assembly (PBA). The controller 36 may be configured to control the operation of the cleaner 1.

The dust container 100 may be detachably mounted to the housing 20. Referring to FIG. 3, in response to the pushing device 110 being coupled to the dust container 100, a first dust collecting chamber 101 and a second dust collecting chamber 102 may be formed inside the dust container 100.

The dust container 100 may include an outer case 103 forming the dust collecting chambers 101 and 102, and an inner case 104 arranged inside the outer case 103. The outer case 103 may be arranged between the housing 20 and the inner case 104.

A case flow path 105 may be formed between the outer case 103 and the inner case 104. The case flow path 105 may guide the air passing through the first dust collecting chamber 101 to the second dust collecting chamber 102.

The inner case 104 may be arranged inside the outer case 103. The first dust collecting chamber 101 may be formed inside the inner case 104. The inner case 104 may be provided with a filtering device 106. The first dust collecting chamber 101 may collect rubbish, and the rubbish is filtered out when air introduced through the suction head 10 passes through the filtering device 106.

The filtering device 106 may primarily filter out rubbish from the air introduced through the suction head 10. The filtering device 106 may extend along a portion of an inner surface of the inner case 104. The rubbish filtered out by the filtering device 106 may be collected in the first dust collecting chamber 101. The filtering device 106 may be provided as a mesh member.

The inner case 104 may include a case opening 107 through which air guided through the case flow path 105 flows into a rubbish separation device 111.

Air introduced into the rubbish separation device 111 through the case opening 107 may be secondarily filtered by the rubbish separation device 111. The rubbish filtered out by the rubbish separation device 111 may be collected in the second dust collecting chamber 102. The air filtered in the rubbish separation device 111 may be moved toward a motor filter 46.

The pushing device 110 may be detachably mounted to the body 30. The pushing device 110 may be slidably coupled to the dust container 100. The pushing device 110 may include an opening and closing device 120 configured to open and close the first dust collecting chamber 101.

The opening and closing device 120 may be arranged at an end of the pushing device 110 facing the suction head 10. The opening and closing device 120 may be configured to interlock with a first rubbish removing member 131 and a second rubbish removing member 136.

Because the opening and closing device 120 interlocks with the first rubbish removing member 131 and/or the second rubbish removing member 136, it is possible to prevent the first dust collecting chamber 101 from being unintentionally opened, and it is possible to open the dust collecting chambers 101 and 102 only when the rubbish is to be discharged. The opening and closing device 120 may include an opening and closing member 121, an opening and closing cover 122, and an opening and closing sealing member 123.

The opening and closing device 120 may be moved away from the dust container 100 to open the first dust collecting chamber 101 in response to the first rubbish removing member 131 sliding on an inner surface of the first dust collecting chamber 101 and being withdrawn from the first dust collecting chamber 101. The opening and closing device 120 may be moved toward the dust container 100 to close the first dust collecting chamber 101 in response to the first rubbish removing member 131 sliding on the inner surface of the first dust collecting chamber 101 and being inserted into the first dust collecting chamber 101.

The opening and closing member 121 may open and close the first dust collecting chamber 101 as the pushing device 110 slides with respect to the dust container 100. The opening and closing member 121 may include a chamber inlet 121*a* formed to allow air introduced from the suction head 10 to flow into the first dust collecting chamber 101. The chamber inlet 121*a* may be opened and closed by the opening and closing cover 122.

The opening and closing cover 122 may be composed of a material having elasticity. The opening and closing cover 122 may open the chamber inlet 121*a* in a direction in which air flows into the first dust collecting chamber 101. Conversely, the opening and closing cover 122 may be provided not to open the chamber inlet 121*a* in a direction opposite to the direction in which air is introduced from the first dust collecting chamber 101. That is, the opening and closing cover 122 may open the chamber inlet 121*a* in response to the cleaner 1 sucking the rubbish on the surface to be cleaned, but the opening and closing cover 122 may prevent the chamber inlet 121*a* from being opened in the direction in which dust is discharged from the first dust collecting chamber 101. Accordingly, in a state in which the suction head 10 is separated from the cleaner 1, it is possible to prevent the rubbish from scattering from the dust container 100.

The opening and closing cover 122 may include a cover hinge portion 122*a*. In response to the fan motor unit 40 generating the suction force, the opening and closing cover 122 may be elastically deformed in a state in which the cover hinge portion 122*a* is fixed, so as to open the chamber inlet 121*a*. In response to the fan motor unit 40 not generating the suction force, the opening and closing cover 122 may return to a position for closing the chamber inlet 121*a* by the elastic force.

The opening and closing sealing member 123 may be provided to seal between the inner case 104 and the opening and closing member 121. The opening and closing sealing member 123 may be arranged along a rim of the opening and closing member 121. The opening and closing sealing member 123 may be composed of a material having elasticity. The opening and closing sealing member 123 may include a material that is more flexible than that of the opening and closing member 121. The opening and closing sealing member 123 may be in close contact with the inner surface of the inner case 104 to seal the first dust collecting chamber 101. Accordingly, the cleaner 1 according to an embodiment of the disclosure may prevent the rubbish from being discharged from the first dust collecting chamber 101.

The pushing device 110 may include the first rubbish removing member 131 provided to discharge the rubbish from the first dust collecting chamber 101. The first rubbish removing member 131 may be provided to slide on the first dust collecting chamber 101. The first rubbish removing member 131 may include a first mounting portion 132 and a first rubbish removing portion 133 mounted on the first mounting portion 132.

The first rubbish removing portion 133 may be composed of a material having elasticity. The first rubbish removing portion 133 may be formed to be in close contact with an inner wall of the filtering device 106. The first rubbish removing portion 133 may be provided to be in close contact with one surface, on which rubbish is filtered out, of the filtering device 106. In response to the pushing device 110 sliding on the dust container 100, the first rubbish removing portion 133 may slide while being in close contact with the inner surface of the filtering device 106. In response to the pushing device 110 being moved with respect to the dust container 100 in a direction in which the first dust collecting chamber 101 is opened, the first dust removing portion 133 may scrape the inner surface of the filtering device 106 and remove the rubbish, such as hair, tangled on the inner surface of the filtering device 106.

The first rubbish removing member 131 may be movable from a first position, which is between the filtering device 106 and the rubbish separation device 111, to a second position protruding to the outside of the dust container 100. Accordingly, the first rubbish removing member 131 may discharge the rubbish collected in the first dust collecting chamber 101 to the outside. In addition, as the first rubbish removing member 131 protrudes to the outside of the dust container 100, dust collected in the second dust collecting chamber 102 may also be discharged to the outside.

The pushing device 110 may include a first connection portion 119 provided to connect the first rubbish removing member 131 to the opening and closing device 120. The first connection portion 119 may be arranged in the first dust collecting chamber 101. The first rubbish removing member 131 may be interlocked with the opening and closing device 120 by the first connection portion 119.

A discharge opening 118 may be formed between the plurality of first connection portions 119. The discharge opening 118 may be formed between the first rubbish removing member 131 and the opening and closing device 120. In response to the opening and closing device 120 opening the first dust collecting chamber 101 and in response to the first rubbish removing member 131 discharging the rubbish from the first dust collecting chamber 101, the rubbish may be discharged to the outside through the discharge opening 118.

The pushing device 110 may include the rubbish separation device 111. The rubbish separation device 111 may include a cyclone. The rubbish separation device 111 may separate rubbish, which is not filtered out in the first dust collecting chamber 100, from the air by using a centrifugal force. Because the rubbish separation device 111 separates the rubbish from the air passing through the filtering device 106 in a different way from the filtering device 106, the cleaner 1 according to an embodiment of the disclosure may increase the cleaning efficiency.

The pushing device 110 may include the second rubbish removing member 136 provided to discharge the rubbish from the second dust collecting chamber 102. The second rubbish removing member 136 may be provided to slide on the second dust collecting chamber 102 and the first dust collecting chamber 101. The second dust collecting chamber 102 may be formed between the first rubbish removing member 131 and the second rubbish removing member 136. The second rubbish removing member 136 may include a second mounting portion 137 and a second rubbish removing portion 138 mounted on the second mounting portion 137 (see FIG. 5).

The second rubbish removing portion 138 may be composed of a material having elasticity. In response to the pushing device 110 sliding on the dust container 100, the second rubbish removing portion 138 may slide while being in close contact with the inner surface of the inner case 104, so as to discharge the rubbish from the second dust collecting chamber 102. In response to the pushing device 110 sliding on the dust container 100, the second rubbish removing portion 138 may slide while being in close contact with the inner surface of the inner case 104 so as to empty all the rubbish of the second dust collecting chamber 102.

The pushing device 110 may include a second connection portion 129 provided to connect the first rubbish removing member 131 to the second rubbish removing member 136. The second connection portion 129 may be arranged in the second dust collecting chamber 102. The second rubbish removing member 136 may be interlocked with the first rubbish removing member 131 by the second connection portion 129.

The motor filter 46 may be detachably mounted to a filter case 47. The motor filter 46 may be arranged inside the housing 20 in a state of being mounted on the filter case 47 of the pushing device 110. By using the motor filter 46, the cleaner 1 according to an embodiment of the disclosure may prevent the fan motor unit 40 from being damaged by rubbish or the like, and discharge relatively clean air.

The motor filter 46 may include a filter sealing portion 46*a* provided to seal between the motor filter 46 and the filter case 47 upon being mounted on the filter case 47.

The body 30 may include a shutter device 80 configured to open and close a flow path through which the air passing through the motor filter 46 moves to the fan motor unit 40.

The fan motor unit 40 may be configured to generate a suction force in the first dust collecting chamber 101 and the second dust collecting chamber 102. The air passing through the motor filter 46 may pass through the fan motor unit 40 and then be discharged from the housing 20.

According to the above configuration, when the cleaner 1 according to an embodiment of the disclosure performs a cleaning operation, the air containing the rubbish introduced from the suction head 10 may be primarily filtered by the filtering device 106 of the first dust collecting chamber 101. Thereafter, the air that flows to the rubbish separation device 111 through the case flow path 105 may be secondarily filtered. The air filtered by the rubbish separation device 111 may be collected in the second dust collecting chamber 102. The air passing through the rubbish separation device 111 may be thirdly filtered by passing through the motor filter 46, and then pass through the fan motor unit 40. The air passing through the fan motor unit 40 may be discharged through the motor discharge port 41 and the discharge port 23 of the housing 20.

Referring to FIG. 6, when a user wants to empty the rubbish collected in the dust collecting chambers 101 and 102 after the cleaning operation is finished, the user may slide the body 30 with respect to the housing 20. In this case, the user may operate the button device 92 to move the body 30.

In response to the body 30 sliding inside the housing 20, the opening and closing device 120 arranged at one end of the pushing device 110 may open the first dust collecting chamber 101, and the first rubbish removing member 131 may slide on one surface, on which the rubbish is placed, of the filtering device 106, and the second rubbish removing member 136 may slide on the inner surface of the second dust collecting chamber 102 and slide on one surface, on which the rubbish is placed, of the filtering device 106. The first rubbish removing member 131 may separate the rubbish placed in the filtering device 106 and discharge the rubbish to the outside of the first dust collecting chamber 101. The second rubbish removing member 136 may discharge the rubbish in the second dust collecting chamber 102 to the outside, and at the same time, the second rubbish removing member 136 may secondarily separate rubbish placed in the filtering device 106 so as to discharge the rubbish to the outside of the first dust collecting chamber 101.

For this, the first rubbish removing member 131 and the second rubbish removing member 136 may be moved to a position in which the first rubbish removing member 131 and the second rubbish removing member 136 protrude to the outside of the housing 20. In contrast, the pushing device 110 may be moved to allow only the opening and closing device 120 to be exposed to the outside of the housing 20, and to prevent the first rubbish removing member 131 and the second rubbish removing member 136 from being exposed to the outside of the housing 20. In addition, the pushing device 110 may be moved to allow only the opening and closing device 120 and the first rubbish removing member 131 to be exposed to the outside of the housing 20, and to prevent the second rubbish removing member 136 from being exposed to the outside of the housing 20.

After the dust 200 discharge of the dust collecting chambers 101 and 102 is completed, the user can move the handle 90 of the body 30 in a direction away from the housing 20, and accordingly, the opening and closing device 120 is moved to a position for closing the first dust collecting chamber 101. In addition, the button device 92 may fix the position of the body 30 with respect to the housing 20.

The cleaner 1 according to an embodiment of the disclosure may easily empty the rubbish of the dust collecting chambers 101 and 102 with a relatively simple operation by the above-mentioned configuration. Further, the opening and closing device 120 is configured to open and close the dust collecting chambers 101 and 102 only when the dust collecting chambers 101 and 102 discharge the rubbish, and thus even when the housing 20 is separated from the suction head 10, it is possible to prevent the rubbish from scattering.

Figure 7:
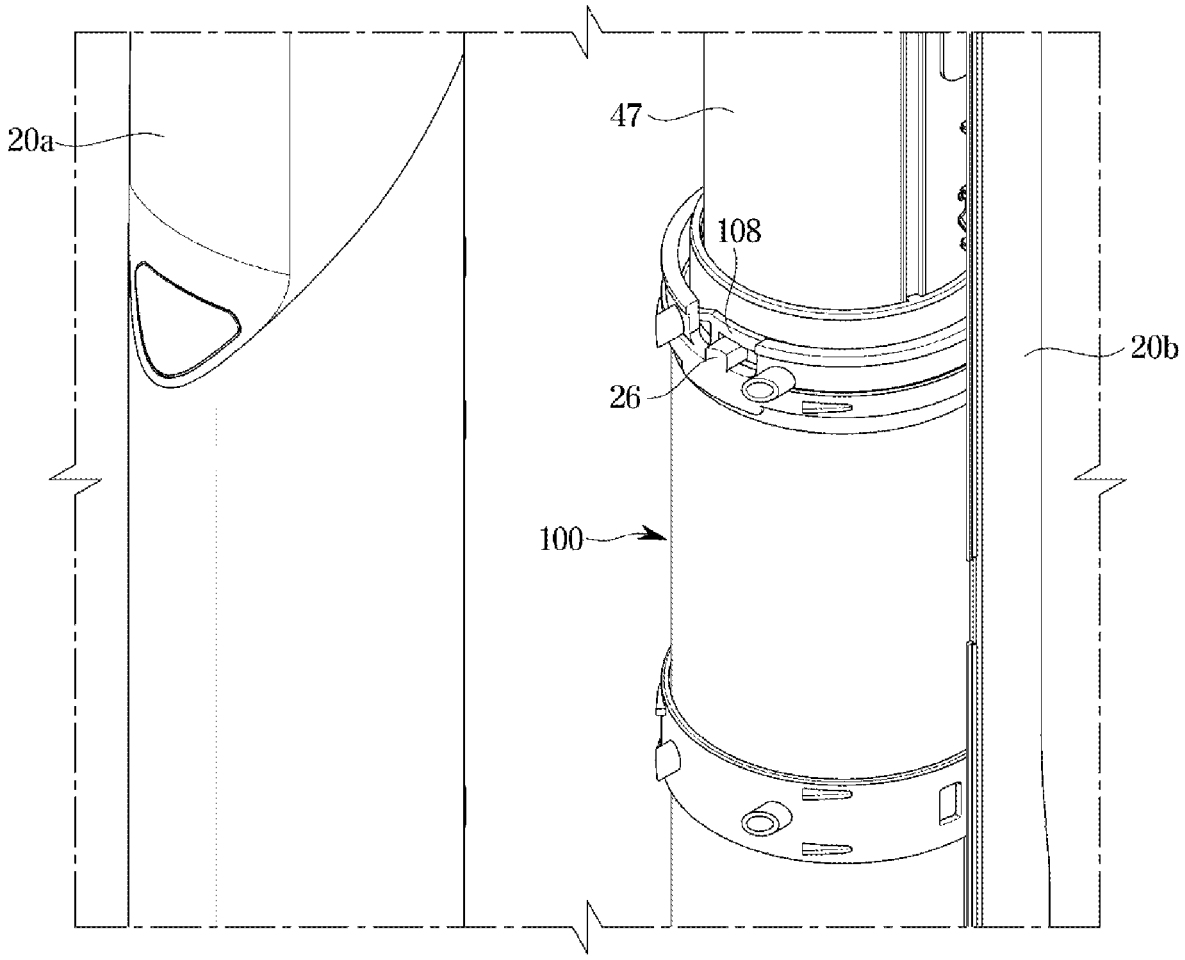
FIG. 7 is a view illustrating a portion in which a front housing of the cleaner illustrated in FIG. 1 is separated.
Figure 8:
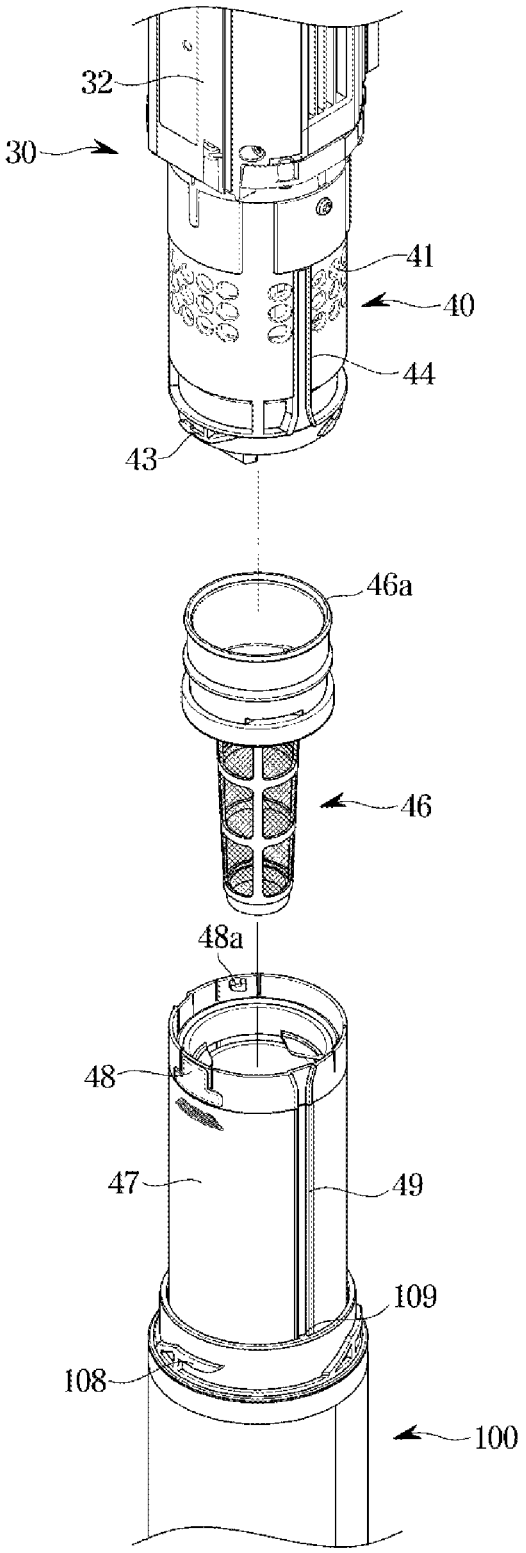
FIG. 8 is a view illustrating a portion in which a body illustrated in FIG. 2 is coupled to a pushing device.
Figure 9:
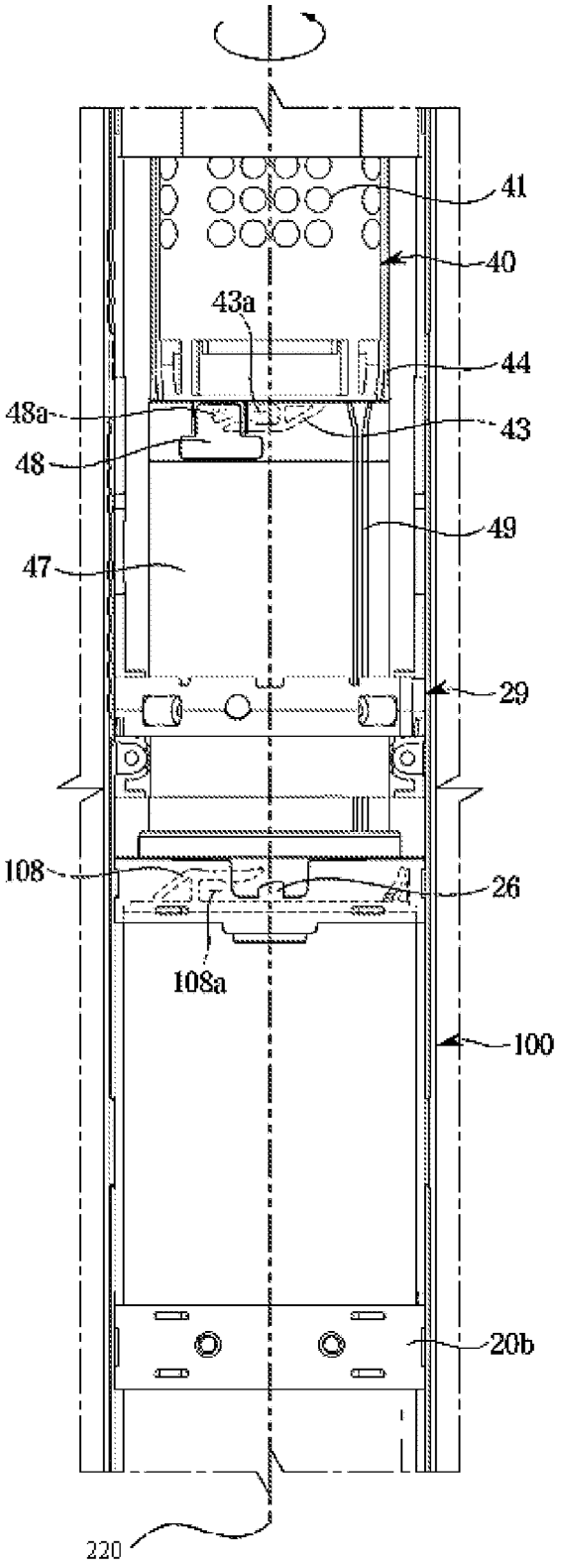
FIG. 9 is a view illustrating a state before a dust container and the pushing device are respectively coupled to a housing and the body in a state in which the front housing is removed from the cleaner illustrated in FIG. 1.
Figure 10:
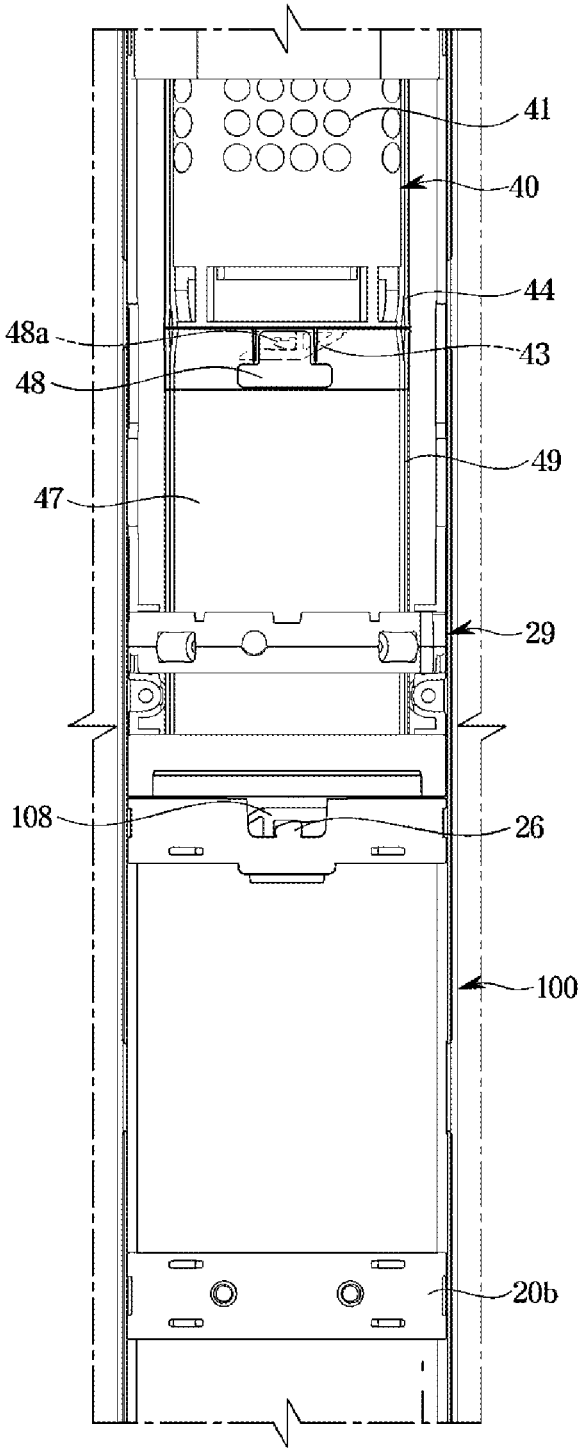
FIG. 10 is a view illustrating a state in which the dust container and the pushing device are respectively coupled to the housing and the body in a state in which the front housing is removed from the cleaner illustrated in FIG. 1.

FIG. 7 is a view illustrating a portion in which a front housing of the cleaner illustrated in FIG. 1 is separated. FIG. 8 is a view illustrating a portion in which a body illustrated in FIG. 2 is coupled to a pushing device. FIG. 9 is a view illustrating a state before a dust container and the pushing device are respectively coupled to a housing and the body in a state in which the front housing is removed from the cleaner illustrated in FIG. 1. FIG. 10 is a view illustrating a state in which the dust container and the pushing device are respectively coupled to the housing and the body in a state in which the front housing is removed from the cleaner illustrated in FIG. 1.

A coupling structure between the dust container 100 and the housing 20 and a coupling structure between the pushing device 110 and the body 30 will be described with reference to FIGS. 7 to 10.

Referring to FIGS. 7, 9, and 10, a housing coupling portion 26 may be formed in the rear housing 20*b* of the housing 20. The housing coupling portion 26 may have a protrusion shape. The housing coupling portion 26 may protrude from an inner circumferential surface of the housing 20. A plurality of housing coupling portions 26 may be provided along the inner circumferential surface of the housing 20.

The dust container 100 may include a dust container coupling portion 108 formed to be coupled to the housing coupling portion 26. The dust container coupling portion 108 may include a dust container coupling groove 108*a* formed to receive the housing coupling portion 26. The housing coupling portion 26 may be formed to be insertable into the dust container coupling groove 108*a*. A plurality of dustbin coupling parts 108 may be provided along an outer circumferential surface of the dust container 100 to correspond to the housing coupling portion 26. The dust container coupling portion 108 may be formed at the other end opposite to the one end 100*a* inserted into the suction head 10 of the dust container 100.

For example, referring to FIG. 9, the dust container 100 is inserted into the housing 20 in such a way that the dust container coupling portion 108 does not interfere with the housing coupling portion 26. Referring to FIG. 10, as the dust container 100 is rotated about a central axis 220 in a first direction with respect to the housing 20, the housing coupling portion 26 is accommodated in the dust container coupling groove 108*a* of the dust container coupling portion 108. Accordingly, the dust container 100 may be coupled to the housing 20 and thus a movement of the dust container 100 in an extending direction of the housing 20 may be limited. The movement of the dust container 100 may be limited in a direction of being separated from the housing 20 and in a direction of being mounted to the housing 20.

Referring to FIGS. 8 to 10, the pushing device 110 may be provided with a pushing device coupling portion 48. The pushing device coupling portion 48 may include a coupling protrusion 48*a* having a protrusion shape. The coupling protrusion 48*a* may protrude from an inner circumferential surface of the pushing device 110. A plurality of pushing device coupling portions 48 may be provided along a circumference of the pushing device 110. The plurality of coupling protrusions 48*a* may be provided along the inner circumferential surface of the pushing device 110.

The pushing device coupling portion 48 may be formed at one end of the filter case 47 to which the motor filter 46 is mounted. The pushing device coupling portion 48 may be positioned at the other end opposite to one end of the pushing device 110 in which the opening and closing device 120 is positioned. The pushing device coupling portion 48 may be formed in such a way that at least a portion thereof is separated from the filter case 47.

The body 30 may include a body coupling portion 43 formed to be coupled to the pushing device coupling portion 48. The coupling protrusion 48*a* of the pushing device coupling portion 48 may be formed to be inserted into a body coupling groove 43*a* formed in the body coupling portion 43. A plurality of body coupling portions 43 may be provided along an outer circumferential surface of the body 30 to correspond to the pushing device coupling portions 48. The body coupling portion 43 may be positioned at the other end opposite to the one end at which the handle 90 is arranged. The body coupling portion 43 may be formed on one side on which the fan motor unit 40 is arranged.

For example, referring to FIG. 9, the pushing device 110 is inserted into the housing 20 in such a way that the pushing device coupling portion 48 does not interfere with the body coupling portion 43. Referring to FIG. 10, as the pushing device 110 is rotated in the first direction with respect to the body 30, the coupling protrusion 48*a* of the pushing device coupling portion 48 may be accommodated in the body coupling groove 43*a* of the body coupling portion 43. Accordingly, the pushing device 110 may be coupled to the body 30 and thus the movement of the pushing device 110 in the extending direction of the body 30 may be limited.

Referring to FIG. 8, the dust container 100 may include a guide portion 109 provided to guide a sliding movement of the pushing device 110. The guide portion 109 may protrude from the inner circumferential surface of the dust container 100. A plurality of guide portions 109 may be provided along the inner circumferential surface of the dust container 100.

The pushing device 110 may include a guide rail 49 formed to be guided by the guide portion 109. The guide rail 49 may extend along a movement direction of the pushing device 110. The guide portion 109 is formed to be inserted into the guide rail 49. A plurality of guide rails 49 may be provided along the outer circumferential surface of the pushing device 110 to correspond to the guide portion 109.

As the guide portion 109 is inserted into the guide rail 49, the pushing device 110 may slide on the dust container 100 but may be not rotated with respect to the dust container 100. That is, the pushing device 110 may be configured to be rotated together with the dust container 100.

The body 30 may include a body rail 44 formed to be guided by the guide portion 109. The body rail 44 may extend along the movement direction of the body 30 with respect to the housing 20. A plurality of the body rails 44 may be provided along the outer circumferential surface of the body 30 to correspond to the guide portion 109.

Referring to FIGS. 9 and 10, the housing coupling portion 26 of the housing 20 and the body coupling portion 43 of the body 30 may be arranged on substantially the same line. In addition, in response to the pushing device 110 being detachably coupled to the dust container 100, the dust container coupling portion 108 and the pushing device coupling portion 48 may be arranged on substantially the same line. In response to the dust container 100, to which the pushing device 110 is slidably coupled, being inserted into the housing 20 and then being rotated so as to be coupled to the housing 20, the pushing device 110 may be also coupled to the body 30 by the above-mentioned arrangement. That is, in the cleaner 1 according to an embodiment of the disclosure, due to an operation in which the dust container 100, to which the pushing device 110 is coupled, is coupled to the housing 20, the pushing device 110 may be also coupled to the body 30. Accordingly, in the cleaner 1 according to an embodiment of the disclosure, the pushing device 110 and the dust container 100 may be detachably mounted to the body 30 and the housing 20, respectively, through a relatively simple operation.

Figure 11:
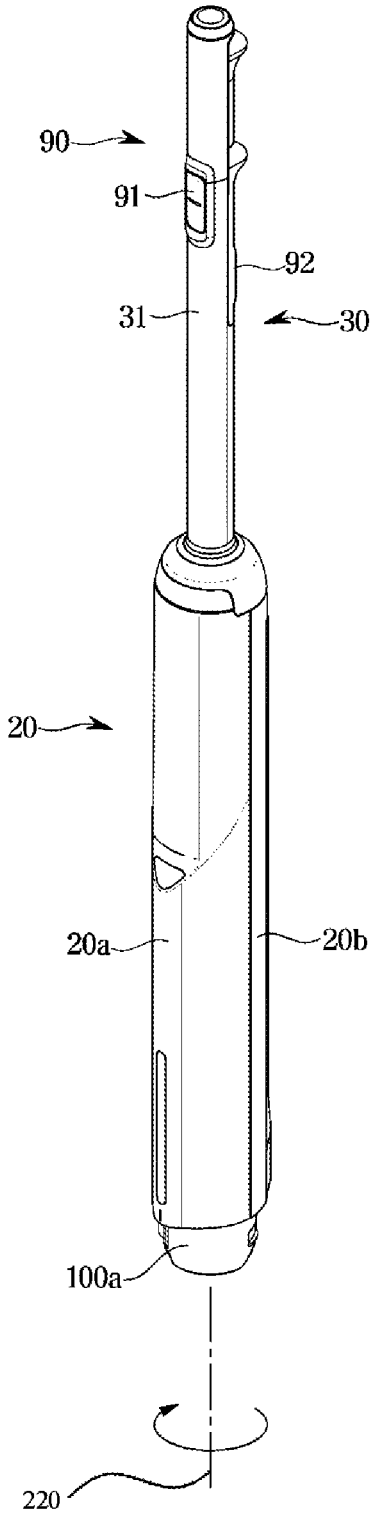
FIG. 11 is a view illustrating a state in which the dust container and the pushing device are rotated with respect to the housing and the body in order to separate the dust container and the pushing device from the cleaner illustrated in FIG. 1.
Figure 12:
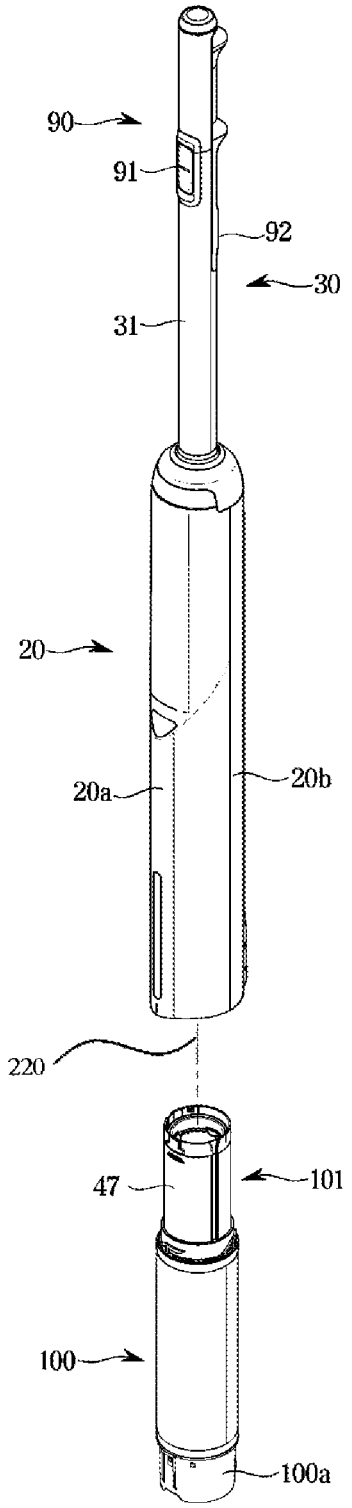
FIG. 12 is a view illustrating a state in which the dust container and the pushing device are separated from the cleaner illustrated in FIG. 11.

FIG. 11 is a view illustrating a state in which the dust container and the pushing device are rotated with respect to the housing and the body in order to separate the dust container and the pushing device from the cleaner illustrated in FIG. 1. FIG. 12 is a view illustrating a state in which the dust container and the pushing device are separated from the cleaner illustrated in FIG. 11.

A process of separating the dust container 100 and the pushing device 110 from the housing 20 and the body 30 will be described with reference to FIGS. 11 and 12.

Referring to FIG. 11, a user rotates about the central axis 220 the one end 100*a*, which protrudes to the outside of the housing 20, of the dust container 100 with respect to the housing 20. For example, the user rotates the dust container 100 with respect to the housing 20 in a second direction opposite to the first direction in which the dust container 100 illustrated in FIGS. 9 and 10 is mounted on the housing 20.

In response to the dust container 100 being rotated in the second direction, the pushing device 110 is also rotated together with the dust container 100 in the second direction. Accordingly, the dust container 100 and the pushing device 110 in the state illustrated in FIG. 10 is changed to the state illustrated in FIG. 9. That is, the housing coupling portion 26 of the housing 20 is separated from the dust container coupling portion 108 of the dust container 100, and the coupling protrusion 48*a* of the pushing device coupling portion 48 of the pushing device 110 is separated from the body coupling portion 43 of the body 30.

Referring to FIG. 12, the user can withdraw the dust container 100 and the pushing device 110 from the housing 20.

The cleaner 1 according to an embodiment of the disclosure may easily separate the dust container 100 from the housing 20 and maintain and/or repair the dust container 100 by the above-mentioned configuration.

Further, referring to FIG. 6, the housing 20 may include an insertion guide 20*aa* to align an insertion position of the dust container 100 with respect to the housing 20 upon mounting the dust container 100 on the housing 20. The user places an insertion portion 100*aa*, which is formed at the one end 100*a* of the dust container 100, in the insertion guide 20*aa* of the housing 20 and then the user inserts the dust container 100 into the housing 20. Accordingly, the user can mount the dust container 100 to a correct position.

Figure 13:
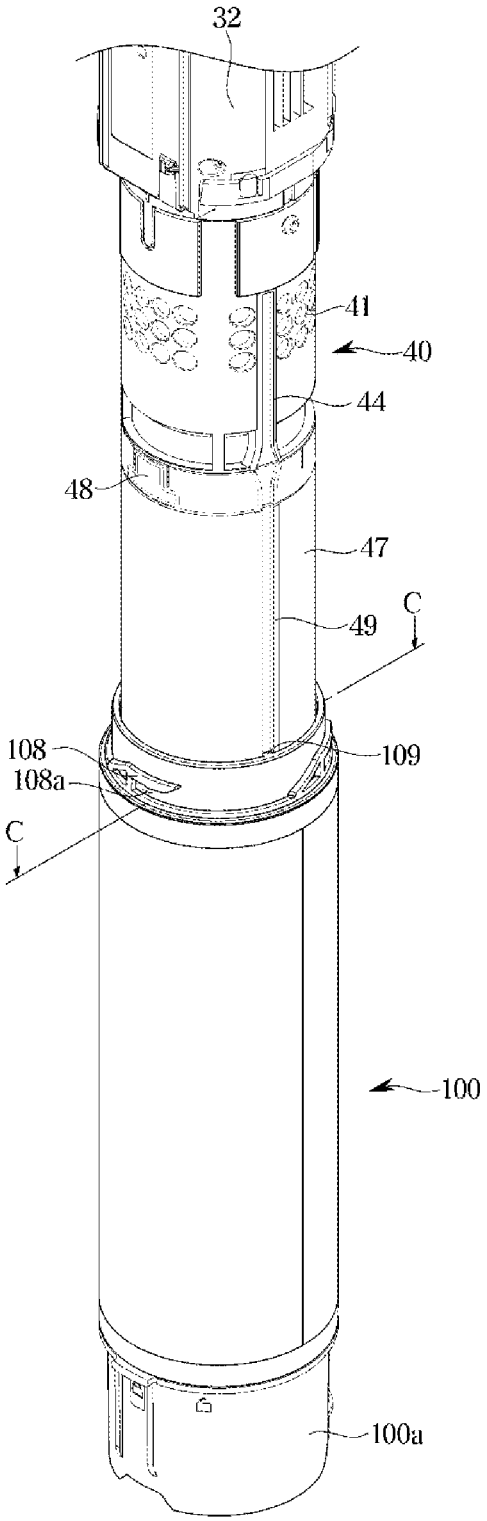
FIG. 13 is a view illustrating a portion in which the body illustrated in FIG. 2 is coupled to the pushing device.
Figure 14:
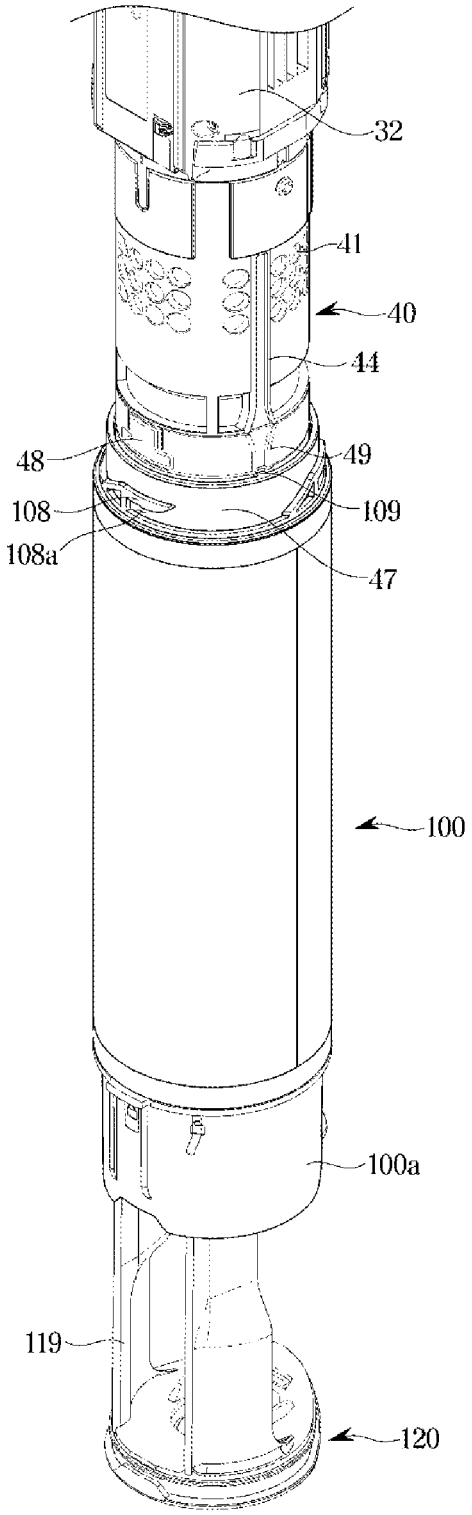
FIG. 14 is a view illustrating a state in which the pushing device illustrated in FIG. 13 slides with respect to the dust container.
Figure 15:
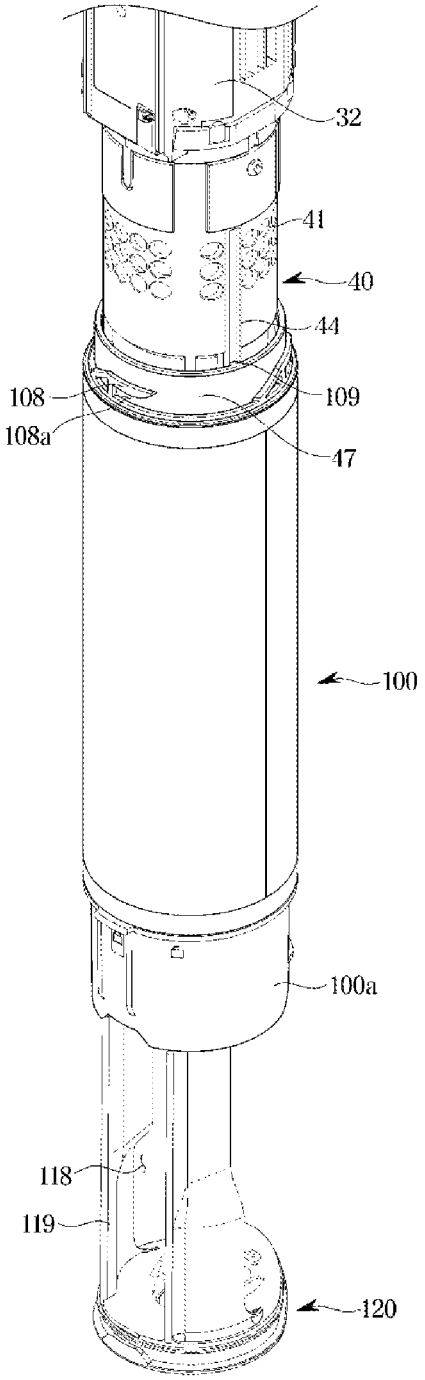
FIG. 15 is a view illustrating a state in which the body illustrated in FIG. 14 slides to an inside of the dust container.
Figure 16:
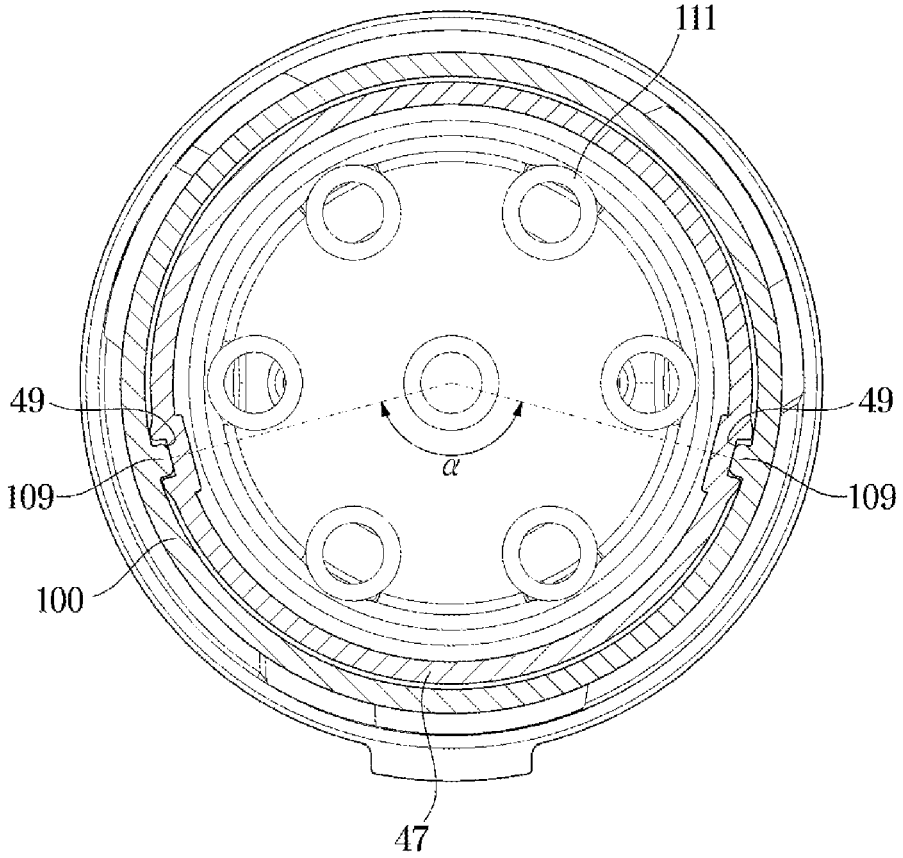
FIG. 16 is a sectional-view taken along line C-C illustrated in FIG. 13.

FIG. 13 is a view illustrating a portion in which the body illustrated in FIG. 2 is coupled to the pushing device. FIG. 14 is a view illustrating a state in which the pushing device illustrated in FIG. 13 slides with respect to the dust container. FIG. 15 is a view illustrating a state in which the body illustrated in FIG. 14 slides to an inside of the dust container. FIG. 16 is a sectional-view taken along line C-C illustrated in FIG. 13.

A sliding movement of the pushing device 110 with respect to the dust container 100 will be described with reference to FIGS. 13 to 15.

Referring to FIG. 13, the dust container 100 may include the guide portion 109 protruding from the inner circumferential surface. The pushing device 110 may include the guide rail 49 formed to be guided by the guide portion 109. The guide rail 49 may be formed on the outer circumferential surface of the pushing device 110. The guide rail 49 may be formed in the filter case 47 of the pushing device 110. The guide rail 49 may extend along the direction in which the pushing device 110 slides on the dust container 100 (i.e., a lengthwise or longitudinal direction of the filter case 47 which may have a cylindrical shape).

The body rail 44 may be provided on the fan motor unit 40 of the body 30. The body rail 44 may be connected to the guide rail 49 in response to the body 30 being coupled to the pushing device 110. The body rail 44 may be formed to be guided by the guide portion 109.

For example, referring to FIG. 14, in response to the guide rail 49 being guided by the guide portion 109 of the dust container 100, the pushing device 110, which is coupled to the body 30, may slide on the dust container 100. For example, the pushing device 110 may be guided by the guide portion 109, and the opening and closing device 120 may be moved in a direction, which is for opening the dust collecting chambers 101 and 102 formed inside the dust container 100, with respect to the dust container 100.

As illustrated in FIG. 15, in response to a part of the body 30 being moved into the dust container 100 after the guide portion 109 is moved to a point at which the guide rail 49 is in contact with the body rail 44, the body rail 44 may be guided by the guide portion 109. Accordingly, the body 30 may be guided by the guide portion 109 and be moved linearly with respect to the dust container 100.

As for the cleaner 1 according to an embodiment of the disclosure, the pushing device 110 in the state of being coupled to the body 30 may be moved stably and linearly with respect to the dust container 100 by the above-mentioned configuration.

Referring to FIG. 16, the guide portion 109 may be provided as a plurality of guide portions 109. For example, the plurality of guide portions 109 may be arranged such that an angle ($\alpha$) with respect to the center of the dust container 100 is an acute angle. For example, a first guide portion may be disposed to form an angle with a second guide portion which is less than 90° (an acute angle) with respect to the central axis 220 along a direction in which the dust container extends. A plurality of guide portions 109 may be arranged such that an angle ($\alpha$) with respect to the center of the dust container 100 is more than 90° and less than 180°. For example, a first guide portion may be disposed to form an angle with a second guide portion which is more than 90° and less than 180° (an obtuse angle) with respect to the central axis 220 along the direction in which the dust container extends. That is, the plurality of guide portions 109 may be arranged such that the angle (α) with respect to the center of the dust container 100 is not 180°. By this configuration, it is possible that the pushing device 110 is mounted to the dust container 100 only in a predetermined mounting direction. That is, in response to the pushing device 110 being mounted on the dust container 100, the pushing device 110 may have directionality.

Figure 17:
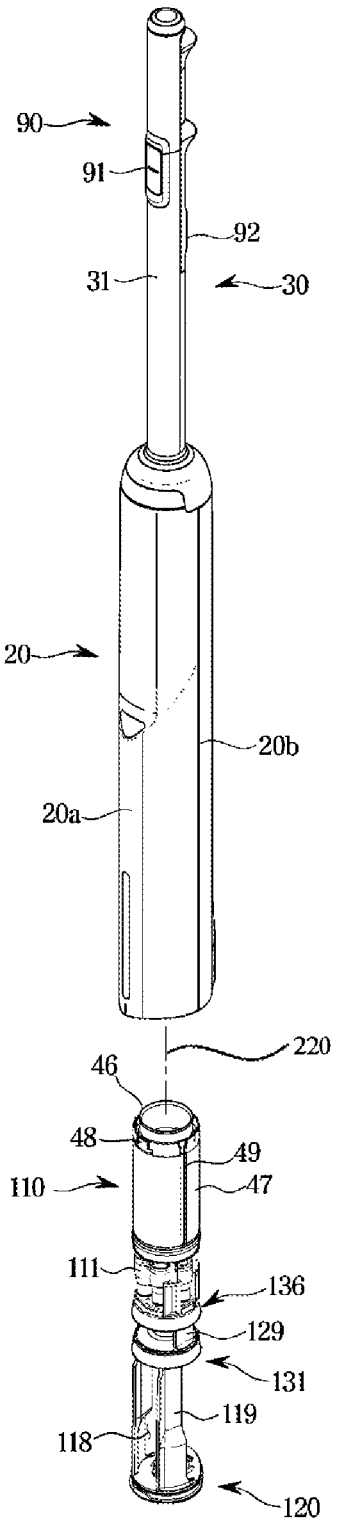
FIG. 17 is a view illustrating a state in which the pushing device is separated from the cleaner illustrated in FIG. 11.
Figure 18:
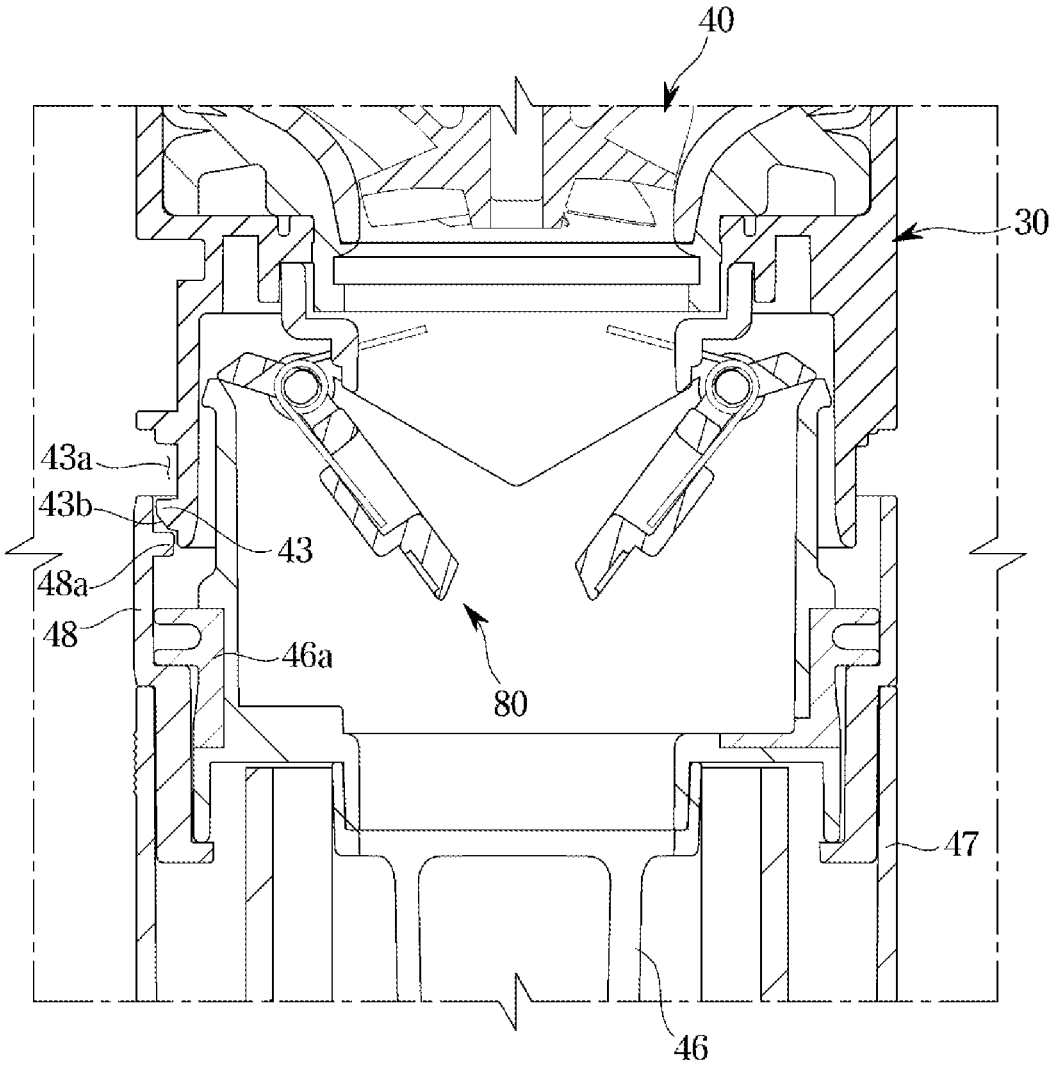
FIG. 18 is an enlarged cross-section illustrating a part D illustrated in FIG. 3, for example, a view illustrating a state before the pushing device is coupled to the body.
Figure 19:
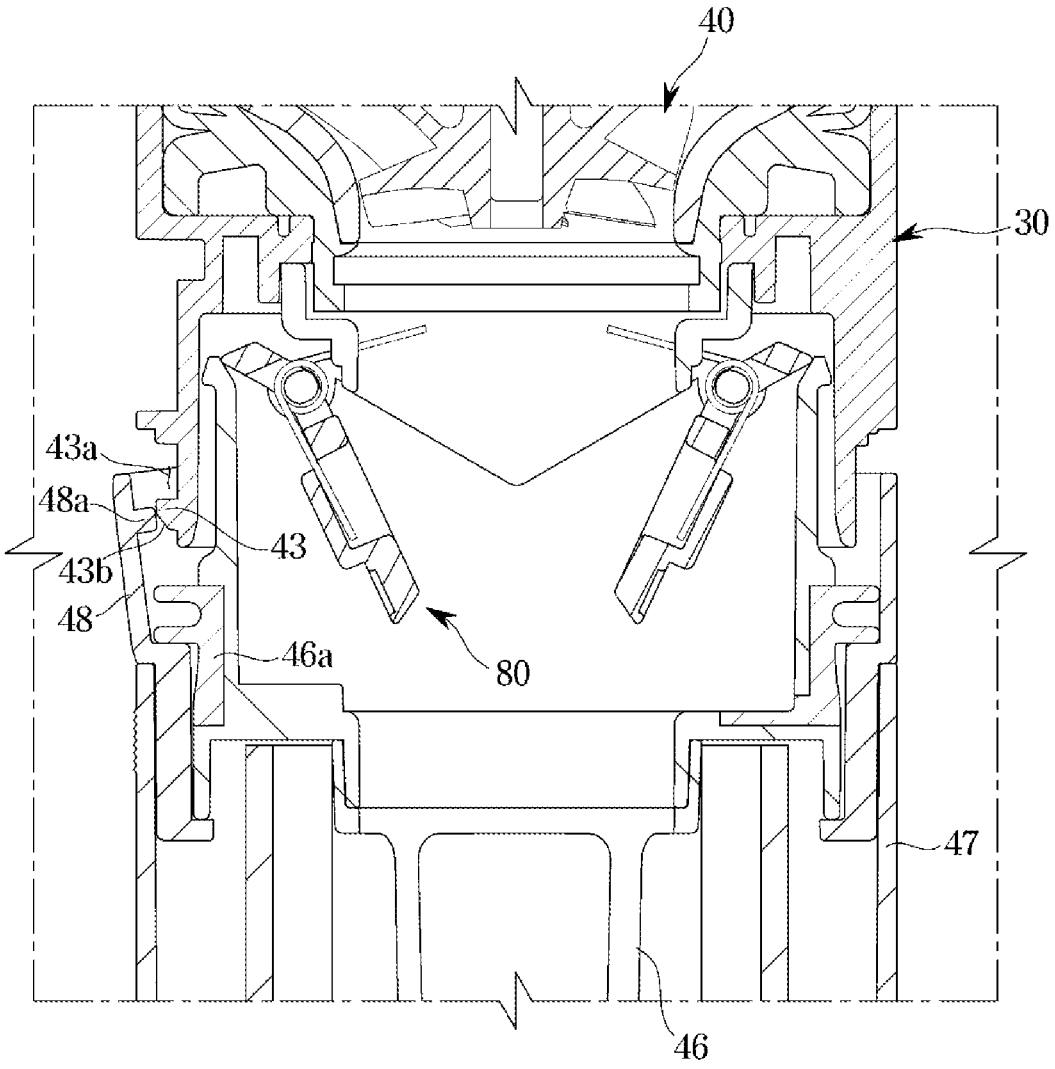
FIG. 19 is a view illustrating a process in which the pushing device illustrated in FIG. 18 is coupled to the body.
Figure 20:
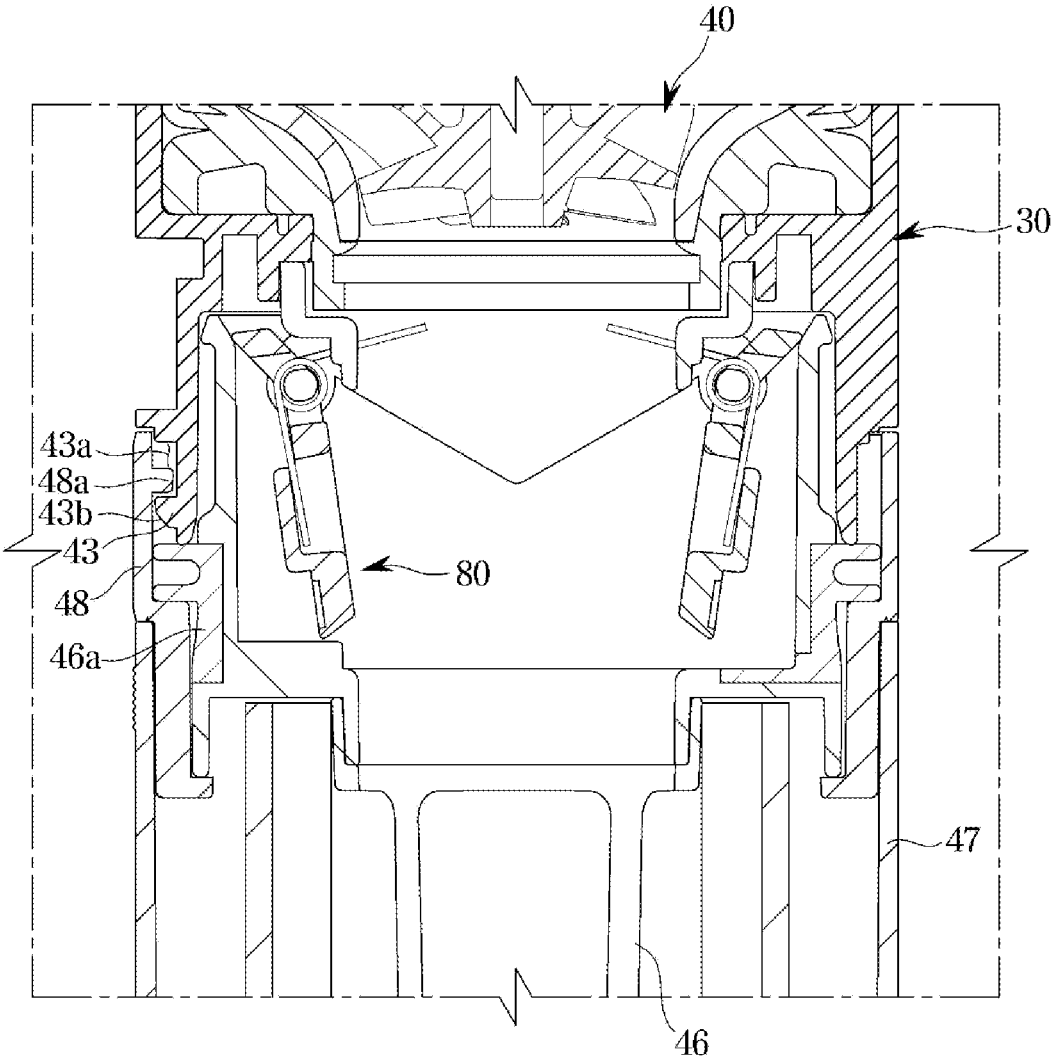
FIG. 20 is a view illustrating a state in which the pushing device illustrated in FIG. 19 is coupled to the body.

FIG. 17 is a view illustrating a state in which the pushing device is separated from the cleaner illustrated in FIG. 11. FIG. 18 is an enlarged cross-section illustrating a part D illustrated in FIG. 3, for example, a view illustrating a state before the pushing device is coupled to the body. FIG. 19 is a view illustrating a process in which the pushing device illustrated in FIG. 18 is coupled to the body. FIG. 20 is a view illustrating a state in which the pushing device illustrated in FIG. 19 is coupled to the body.

A case, in which the pushing device 110 is separated from the body 30 and the dust container 100 in the state in which the dust container 100 is mounted on the housing 20, will be described with reference to FIGS. 17 to 20.

Referring to FIG. 17, in a state in which the dust container 100 and the pushing device 110 are separated from the housing 20 and the body 30, a case of mounting only the dust container 100 to the housing 20 after the pushing device 110 is separated from the dust container 100 may occur. In this case, the dust container 100 is already mounted on the housing 20, and thus when trying to insert the pushing device 110 into the dust container 100 and mount the dust container 100 to the body 30, the pushing device 110 may be not mounted to the body 30 in a way in which the pushing device 10 is inserted to the dust container 100 and then mounted in a rotation method.

Even in this case, in order to insert the pushing device 110 into the dust container 100 and then mount the dust container 100 to the body 30, the pushing device coupling portion 48 may be composed of a material having elasticity. Further, the body coupling portion 43 may include a guide inclined portion 43*b* provided to guide the coupling of the pushing device coupling portion 48.

For example, referring to FIG. 18, as the pushing device 110 is inserted into the dust container 100, the pushing device coupling portion 48 is moved to a position adjacent to the body coupling portion 43.

Referring to FIG. 19, as the pushing device 110 is continuously pressed toward the body 30, the pushing device coupling portion 48 may be guided by the guide inclined portion 43*b* of the body coupling portion 43 and then deformed.

Referring to FIG. 20, as the pushing device 110 is continuously pressed toward the body 30, the coupling protrusion 48*a* of the pushing device coupling portion 48 may be accommodated in the body coupling groove 43*a* of the body coupling portion 43 and the pushing device coupling portion 48 may be restored to its original shape by elasticity.

In the cleaner 1 according to an embodiment of the disclosure, even when the pushing device 110 is separated from the body 30 and the dust container 100 in the state in which the dust container 100 is mounted on the housing 20, the pushing device 110 may be easily coupled to the body 30 by the above-mentioned configuration.

As is apparent from the above description, a cleaner may easily discharge rubbish collected in a dust container because a pushing device slides on the dust container.

Further, a cleaner may easily manage a dust container because the dust container is separable from a housing.

Although example embodiments of the disclosure have been shown and described, it would be appreciated by those skilled in the art that changes may be made to these embodiments without departing from the principles and spirit of the disclosure, the scope of which is defined in the claims and their equivalents.

What is claimed is:

1. A cleaner, comprising:

a housing having a housing coupling portion;

a body slidably couplable to the housing, and having a body coupling portion;

a dust container having a dust container coupling portion; and a pushing device slidably couplable to the dust container, and having a pushing device coupling portion, wherein the housing, the body, the dust container, and the pushing device are configured so that:

with the pushing device slidably coupled to the dust container and the body slidably coupled to the housing, the pushing device and the dust container together are slidable into the housing, and the dust container and the pushing device are together rotatable in a first direction with respect to the housing and the body, so that the housing coupling portion becomes coupled to the dust container coupling portion and the pushing device coupling portion becomes coupled to the body coupling portion.

2. The cleaner of claim 1, wherein with the pushing device slidably coupled to the dust container and the body slidably coupled to the housing, the dust container and the pushing device are together rotatable in a second direction, opposite to the first direction, with respect to the housing and the body so that:

the housing coupling portion becomes decoupled from the dust container coupling portion, and the pushing device coupling portion becomes decoupled from the body coupling portion.

3. The cleaner of claim 1, wherein the housing coupling portion and the body coupling portion are on a same line in an axial direction of the cleaner.

4. The cleaner of claim 1, wherein the pushing device coupling portion includes a material having elasticity, and the body coupling portion includes a guide inclined portion, and the guide inclined portion guides the pushing device coupling portion to a position of being coupled to the body coupling portion as the pushing device is moved linearly and then mounted to the body.

5. The cleaner of claim 1, wherein the dust container includes a guide portion, the pushing device includes a guide rail, and the dust container and the pushing device are configured so that:

with the pushing device slidably coupled to the dust container, the guide portion is received in the guide rail, and a sliding movement of the pushing device relative to the dust container is guided by movement of the guide portion along the guide rail.

6. The cleaner of claim 5, wherein the body includes a body rail, and the body, the dust container, and the pushing device are configured so that:

with the pushing device slidably coupled to the dust container, the pushing device and the dust container together are rotatable in the first direction with respect to the body, so that:

the pushing device coupling portion becomes coupled to the body coupling portion and the body rail becomes connected to the guide rail so that a sliding movement of the body relative to the dust container is guided by movement of the guide portion along the body rail.

7. The cleaner of claim 5, wherein the guide portion includes a first guide portion and a second guide portion, and the second guide portion is disposed to form an angle with the first guide portion which is less than 180 degrees, with respect to a central axis of the dust container.

8. The cleaner of claim 5, wherein the guide portion is configured to limit rotation of the pushing device with respect to the dust container.

9. The cleaner of claim 1, wherein the dust container includes a filtering device, and the pushing device includes a rubbish separation device to separate rubbish from air passing through the filtering device.

10. The cleaner of claim 9, wherein the pushing device includes:

a first rubbish removing member, and a second rubbish removing member, and the pushing device and the dust container are configured so that:

with the pushing device slidably coupled to the dust container, the first rubbish removing member is configured to discharge dust filtered out in the filtering device and the second rubbish removing member is configured to discharge rubbish filtered out in the rubbish separation device when the pushing device is slid inside the dust container.

11. The cleaner of claim 1, wherein the pushing device includes an opening and closing cover, and the pushing device and the dust container are configured so that:

with the pushing device slidably coupled to the dust container and the pushing device slid into the dust container so that the opening and closing cover is at an end of the dust container, the opening and closing cover is configured to open and close the end of the dust container.

12. The cleaner of claim 1, wherein the body includes:

a fan motor unit disposed on a first side of the body having the body coupling portion, a handle disposed on a second side of the body which is opposite to the first side of the body, a battery mounting portion between the fan motor unit and the handle, and the body and the pushing device are configured so that:

the pushing device is rotatable in the first direction with respect to the body so that the pushing device coupling portion becomes coupled to the body coupling portion.

13. The cleaner of claim 12, wherein the pushing device includes a motor filter on a side of the pushing device which is coupled to the body.

* * * * *